United States Patent [19]

Nakamura et al.

[11] Patent Number: 4,561,390

[45] Date of Patent: Dec. 31, 1985

[54] VARIABLE VALVE-TIMING APPARATUS IN AN INTERNAL COMBUSTION ENGINE

[75] Inventors: Norihiko Nakamura, Mishima; Toyokazu Baika; Yoshiaki Shibata, both of Susono; Toshio Miki, Yao, all of Japan

[73] Assignees: Toyota Jidosha Kabushiki Kaisha, Toyota; Koyo Seiko Kabushiki Kaisha, Osaka, both of Japan

[21] Appl. No.: 741,038

[22] Filed: Jun. 4, 1985

Related U.S. Application Data

[63] Continuation of Ser. No. 544,712, Oct. 24, 1983, abandoned.

[30] Foreign Application Priority Data

Nov. 12, 1982 [JP] Japan ..... 57-197803

[51] Int. Cl.[4] ..... F01L 1/34

[52] U.S. Cl. ..... 123/90.15; 123/90.17

[58] Field of Search ..... 123/90.15, 90.16, 90.17; 464/1, 120

[56] References Cited

U.S. PATENT DOCUMENTS 1,632,223 6/1927 Fey ..... 123/90.17

2,682,260 6/1954 Lantz ..... 123/90.17

3,978,829 9/1976 Takahaski et al. ..... 123/90.15

*Primary Examiner*—Michael Koczo

*Assistant Examiner*—Peggy A. Neils

*Attorney, Agent, or Firm*—Kenyon & Kenyon

[57] ABSTRACT

An apparatus for controlling valve timing in an internal-combustion engine. The apparatus includes a pair of telescoping sleeve members. One of the sleeve members is connected to the camshaft of the engine with a bolt, and the other sleeve member is connected to a timing pulley which is connected to the crankshaft of the engine. Each of the sleeve members has at least one slit which is located adjacent to a slit on the other sleeve member. The adjacent slits are angled relative to each other. Abutment rollers are arranged in the slits and are mounted on an axially movable member. The movable member is connected via a screw mechanism to a rotary motor. The rotational movement of the output shaft of the motor is changed to a linear movement of the support member, thereby causing the support member to move, which movement, in turn, causes the generation of angular displacement between the sleeve members so that variable valve-timing is obtained. The output shaft is hollow and is, on the inner end thereof, open to the head portion of the bolt. The other end of the shaft is closed with a plug.

6 Claims, 3 Drawing Figures

VARIABLE VALVE-TIMING APPARATUS IN AN INTERNAL COMBUSTION ENGINE

This application is a continuation of application Ser. No. 544,712, filed Oct. 24, 1983, now abandoned.

BACKGROUND OF THE INVENTION

1. Field of the Invention

The present invention relates to an apparatus for attaining variable control of valve timing in an internal-combustion engine.

2. Description of the Prior Art

Variable control is used to obtain valve timings which can be adapted to various engine operating conditions, such as low-speed and high-speed operation. Many types of such apparatuses have heretofore been proposed. The most typical type of such apparatus includes a mechanism by which the angular relationship between a crankshaft and a camshaft connected thereto is changed. The mechanism conventionally includes differential gears or planetary gears.

A certain degree of backlash inevitably occurs due to the fact that a torque is generated in one direction when the valves open, this direction being opposite to the direction in which a torque is generated when the valves close. This generated backlash causes operational noise to increase and transmission efficiency to decrease.

In order to eliminate the drawbacks encountered in the prior art, in a co-pending patent application, the inventors of the present invention previously proposed a variable valve-timing apparatus wherein a pair of sleeves is connected to a camshaft and a crankshaft, respectively, of an internal-combustion engine. Adjacent slits angled relative to each other are formed in the sleeves. Abutment rollers are arranged in the slits in such a manner that the abutment rollers linearly move along the axis of the camshaft. Due to such a straight movement of the abutment rollers arranged in the corresponding slits, a relative angular displacement is generated between the sleeves so that valve timing may be varied.

SUMMARY OF THE INVENTION

An object of the present invention is to provide a variable valve-timing apparatus in which the assembly thereof is simplified.

Another object of the present invention is to provide a variable valve-timing apparatus capable of effectively lubricating parts such as abutment rollers and inner and outer sleeves while preventing leakage of the lubricant from the apparatus.

According to the present invention, a variable valve-timing apparatus is provided for controlling, in an internal-combustion engine, the relative angular relationship between a camshaft and a power-transmitting member, such as a timing pulley, which is concentric with the axis of the camshaft and is kinematically connected to a crankshaft, the apparatus comprising:

a first sleeve member which is connected to an end of the camshaft;

a fixing member, such as a bolt, for fixedly connecting the first sleeve member to the camshaft;

a second sleeve member which is concentric with respect to the first sleeve member;

bearing means for attaining a rotatable connection between the first sleeve member and the second sleeve member, the second sleeve member being fixedly connected to the power-transmitting member, the first sleeve member having at least one elongated slit, the second sleeve member having at least one elongated slit which is located adjacent to the slit in the first sleeve member, and the adjacent slits being angled relative to each other;

abutment means arranged in the adjacent slits so as to generate a relative angular displacement between the first and the second sleeve members during movement of the abutment means along the first axis;

support means for rotatably supporting the abutment means about a second axis transverse to the first axis;

a motor unit having an output shaft for rotation;

a nut member arranged between the output shaft of the motor and the support means for changing the rotational movement of the output shaft to a linear movement of the support means, the output shaft having a longitudinal opening therethrough which is on one end thereof open adjacent to the fixing member; and means for defining a closed space into which the lubricant is introduced so as to lubricate the abutment means arranged in the slits.

DESCRIPTION OF THE PREFERRED EMBODIMENT

The embodiment of the present invention is now described with reference to the accompanying drawings.

Figure 1:
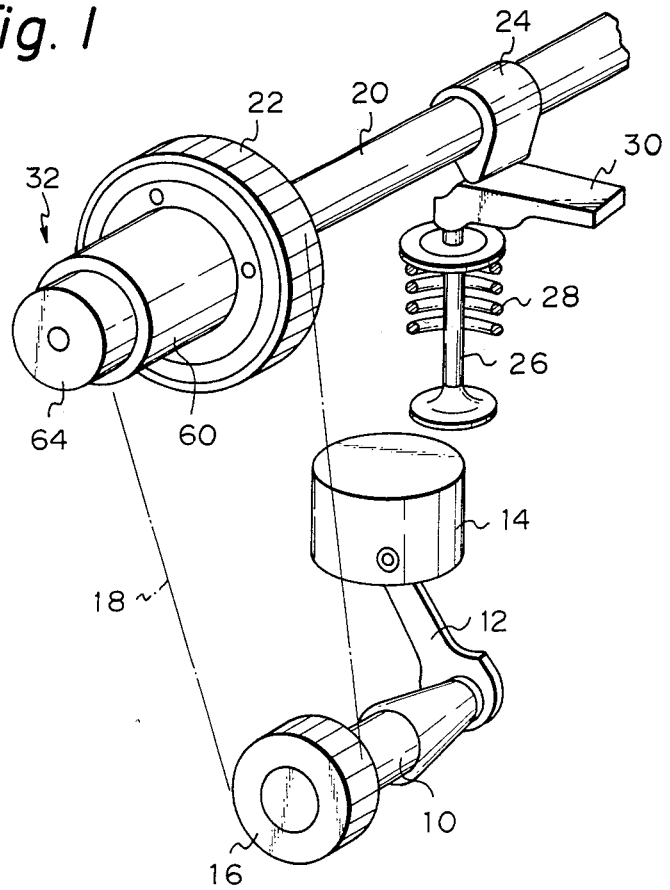
FIG. 1 is a perspective view of a crankshaft connected to a camshaft in an internal-combustion engine.
Figure 2:
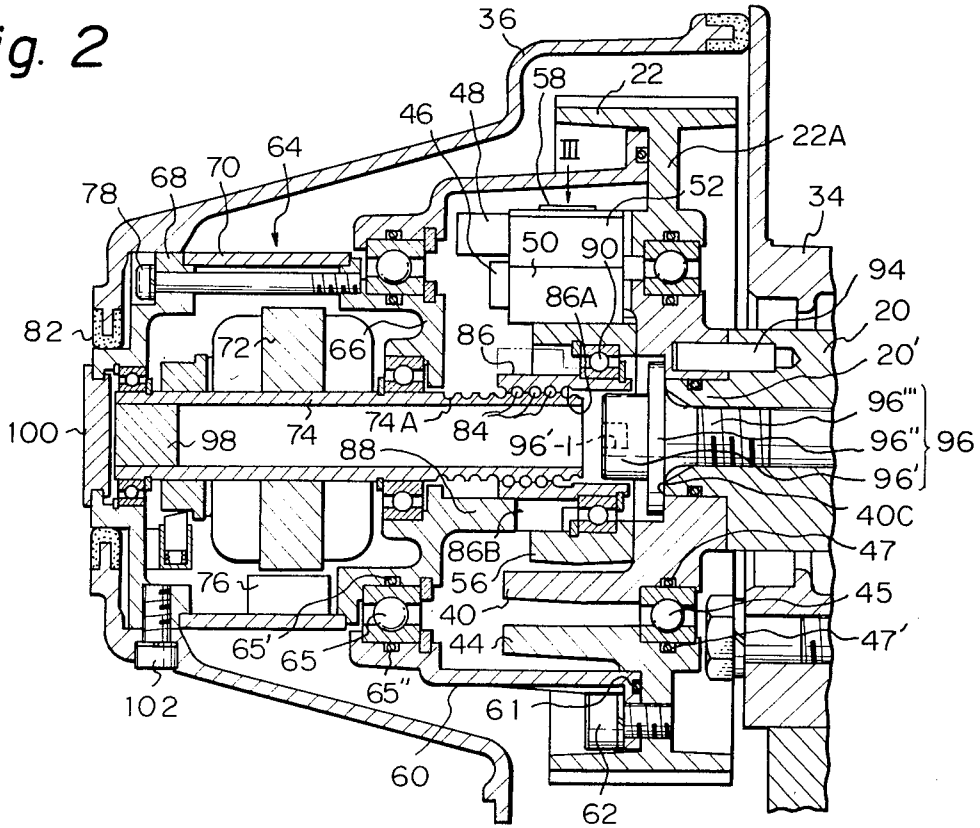
FIG. 2 is a longitudinal cross-sectional view of the apparatus of the present invention.

In FIG. 1, reference numeral 20 denotes a camshaft. The camshaft 20 is rotatably supported on a cylinder head 34 (FIG. 2). To one end of the camshaft 20, a timing pulley 22 is connected via an apparatus for controlling the angular relationship between two rotating bodies of the present invention, this apparatus being generally denoted by reference numeral 32. The timing pulley 22 is connected, via a timing belt 18, to a timing pulley 16 on a crankshaft 10. A piston 14 is connected to the crankshaft 10 by a connecting rod 12. A cam 24 is integrally formed on the camshaft 20. The cam 24 can cooperate with an intake or exhaust valve 26. A valve lifter 30 is arranged between the cam 24 and the valve 26. A spring 28 pushes the valve stem toward the cam 24 so that the valve is normally in a closed position.

The apparatus 32 is adapted for controlling the relative angular relationship between the camshaft 20 and the timing pulley 22 of the internal-combustion engine so as to control the timing of the valve 26. As FIG. 2 shows, the apparatus 32 is essentially comprised of an inner sleeve member 40 and an outer sleeve member 44, which members are concentric with respect to the axis of the camshaft 20. In this embodiment, the outer sleeve member 44 is integral with the timing pulley 22 in such a manner that the outer sleeve member 44 extends from a hub portion 22A of the timing pulley 22. A bearing unit 46 is arranged between the inner sleeve member 40 and the outer sleeve member 44 so as to attain a relative and smooth rotation thereof. The bearing unit 45 is provided with an outer race and an inner race connected to the outer sleeve member 44 and the inner sleeve member 40 via O rings 47 and 47', respectively.

Figure 3:
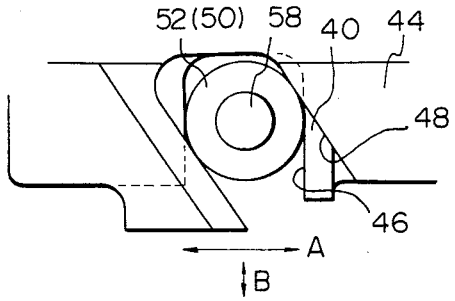
FIG. 3 is a plan view of the apparatus of FIG. 2 seen along the line III—III in FIG. 2.

As is shown in FIG. 3, the inner sleeve member 40 has at least one slit 46, and the outer sleeve member 44 has at least one slit 48 located adajcent to the slit 46 in the inner sleeve member 40. As is also shown in FIG. 3, the slit 46 extends parallel to the axis of the camshaft 20, and the slit 48 is angled with respect to the axis of the camshaft 20 so that the adjacent slits 46 and 48 cross each other. Rollers 50 and 52, as freely rotatable abutment members, are arranged in the slits 46 and 48, respectively.

In FIG. 2, a tubular support member 56, which is concentric with the axis of the camshaft 20, is arranged inside the inner sleeve member 40 so that it is capable of moving horizontally in the direction of the axis of the camshaft 20. A roller support shaft 58 extends radially and integrally out of the tubular support member 56. The rollers 50 and 52, as was mentioned above, are freely rotatably mounted on the roller support shaft 58 in a side-by-side relationship. Reference numeral 60 denotes a tubular case in which the sleeve members 40 and 44, the rollers 50 and 52, the tubular support member 56, and the other parts are housed. The case 60 is at one end connected to the hub portion 22A of the timing pulley 22, via an O ring 61, with bolts 62. The case 60 is at the other end rotatably connected to a motor 64 by means of a bearing unit 65. The bearing unit 65 has an inner race and outer race around which O ring sealing members 65' and 65'' are arranged.

The motor 64 is provided with a front housing 66 and a rear housing 68, a spacer housing 70 therebetween, a tubular or hollow rotating shaft 74, a rotor 72 on the shaft 74, and a stator 76. The housings 66, 68, and 70 are connected to each other with bolts 78. The bearing unit 65 is located on the front housing 66 in order to rotatably support the end of the case 60. The rear housing 68 is sealingly connected to a timing belt cover 36 via a ring-shaped gasket 82.

The shaft 74 of the motor 64 has a portion extending out of the housing 66 toward the camshaft 20, on which portion an outer screw thread 74A is formed. Reference numeral 86 denotes a nut member which has an endless inner screw thread 86A which engages with the screw thread 74A of the shaft 74 via a plurality of balls 84. Such a recirculating ball-screw mechanism is well known. Thus, a detailed description thereof is omitted. The nut member 86 has at its outer surface a groove 86B extending coaxially with the camshaft. The front housing 66 has at a wall thereof facing the camshaft 20 a guide portion 88 extending integrally therefrom. The portion 88 engages with the groove 86B of the nut member 86. The nut member 86 is connected to the tubular support member 56 via a bearing unit 90. Due to such a construction, the rotational movement of the output shaft 74 of the motor 64 is changed to a rectilinear motion of the rollers 50 and 52 in the direction of the camshaft 20 so as to generate relative rotation of the sleeve members 40 and 44.

According to the present invention, the variable valve-timing apparatus 32 is formed as a unit assembly together with the timing pulley 22. The assembly further includes a bolt 96 which has a head portion 96', a flange portion 96'', and a screw portion 96'''. The flange portion 96'' abuts an inner shoulder 40C of the inner sleeve member 40 so as to prevent the bolt 96 from falling out of the assembly. The screw portion 96''' extends out of the inner sleeve member 40. The head portion 96' is provided with a recess 96'-1 so as to engage with a tool (wrench) for connecting the assembly to the end of the camshaft 20. The hollow shaft 74 of the motor 64 is at the inner end thereof open to the head portion 96'.

To install the unit, the inner sleeve member 40 is telescoped onto an end portion 20' of the camshaft 20 while a pin 94 for preventing the unit from rotating with respect to the camshaft is arranged between the inner sleeve member 40 and the camshaft 20. Then a tool is introduced into the hollow shaft 74 from the outer end thereof until it engages with the recess 96'-1 of the head portion 96' of the bolt 96. The bolt 96 is tightened by rotating the tool. Thus, the unit is mounted onto the engine merely by tightening the bolt 96 connected to the camshaft 20.

After the assembly is thus connected to the camshaft 20, grease is introduced from the outer end of the hollow shaft 74 into a space for storing slide mechanisms, such as the abutment rollers 50 and 52, the space being formed inside of the case 60. After the grease is introduced, a plug 98 is fitted into the outer end of the hollow shaft 74, and a cap 100 is fitted onto an opening of the rear housing 68 so as to cover the plug 98. The timing belt cover 36 is then connected to the cover 36 with bolts 102.

The operation of the apparatus according to the present invention is now described. The rotational movement of the crankshaft 10 is transmitted to the timing pulley 22 via the timing belt 18. Thus, the outer sleeve member 44 rotates together with the timing pulley 22 so that a force is applied to the rollers 52 to cause the slit 48 of the outer sleeve member 44 to engage with the roller 52 therein so as to rotate the rollers 52 about the axis of the camshaft 20. As a result, the support member 56 rotates together with the shaft 58. The rotational movement of the shaft 58 causes the slits 46 of the inner sleeve member 40 to engage with the rollers 52 therein, thereby causing the camshaft 20 to rotate. Thus, the crankshaft 10 is connected to the camshaft 20 in rotation. In other words, the timing pulley 22 and the camshaft 20 rotate integrally with each other so that the predetermined angular relationship between the crankshaft 10 and the camshaft 20 is maintained. Thus, the valve 26 cooperating with the cam 24 on the camshaft 20 operates within a predetermined angle range of the crankshaft 10 to open or to close the valve 26. Thus, the predetermined valve timing is obtained.

When it is necessary to change the valve timing due to a change in the operating condition of the engine, the motor 64 is operated to cause the output shaft 74 to rotate. The rotational movement of the shaft 74 is changed into an axial movement of the nut member 86 due to the screw engagement between the parts 74 and 86. Thus, the support member 56 connected to the nut member 86 moves along the axis of the camshaft in FIG. 2 in accordance with the direction of rotation of the shaft 74 of the motor 64. Thus, the shaft 58 provided with the rollers 50 and 52 in the slits 46 and 48, respectively, moves as shown by the arrow B in FIG. 3. Due to the arrangement of the slits 46 and 48, which are angled relative to each other, the linear movement of the rollers 50 and 52 is changed into a relative angular movement between the inner sleeve member 40 and the outer sleeve member 44 as shown by the arrow A in FIG. 3. Thus, the relative angular position between the crankshaft 10 and the camshaft 20 is changed. This means that the valve timing is varied. It should be noted that the degree of angular displacement corresponds to the rotational angle of the motor. The rotational angle of the motor 64 is determined so that a predetermined valve timing change is obtained.

According to the present invention, the variable valve-timing apparatus is constructed as an assembly together with the timing pulley. Furthermore, the shaft of the motor of the apparatus is a hollow shaft 74 open to the head portion 96' of the bolt 96 so as to connect the inner sleeve member of the assembly to the end of the camshaft 20. Thus, the connection of such a unit assembly to the camshaft is effected merely by inserting a tool through the hollow shaft from the outer end thereof and by tightening the bolt 96 through the shaft. This means that production efficiency is increased and maintenance is made easier.

Further, grease for lubricating the parts in the case is introduced into the space inside the case via the outwardly open end of the hollow shaft, thereby preventing the timing belt from being greased and thus damaged.

In addition, the grease for lubricating parts is confined in the casing by the plug 98 fitted into the shaft, as well as by the sealing members. Thus, the leakage of grease during operation of the device is prevented.

While the preferred embodiment of the present invention has been described with reference to the accompanying drawings, various modifications may be made by those skilled in the art without departing from the scope of the present invention.

What is claimed is:

1. A sealed assembly for controllably adjusting an angular relation between a drive source and a camshaft of an internal combustion engine, the assembly comprising:

an annular casing having a first open end and a second open end;

an annular power transmitting member having a sleeve portion extending coaxially inside the casing toward the second end thereof;

first connection means sealingly affixing the power transmitting member to the first end of the casing;

an inner sleeve member disposed coaxially inside the sleeve portion of the power transmitting member, the inner sleeve member and the sleeve portion of the power transmitting member each having a longitudinally extending slit, angled one relative to the other;

a bearing means rotatably and sealingly connecting the power transmitting member to the inner sleeve member;

a motor unit having an enclosed housing and an open tubular drive shaft rotatably mounted in the housing, the drive shaft including a first end extending through a first end of the motor housing and a second end accessible through a second end of the housing, opposite the first end therof;

second connection means for rotatably and sealingly mounting the motor housing at the second end of the casing such that the first end of the motor shaft extends toward the first end of the casing coaxially with the inner and outer sleeves;

means for coupling the one end of the motor shaft to the inner sleeve member and the power transmitting member for controllably adjusting the angular relation between the power transmitting member and the inner sleeve member in response to predetermined angular rotation of the motor shaft with respect to the housing;

a captive fastener retained by the inner sleeve member and disposed coaxially with the motor shaft, the fastener being accessible through the open tubular shaft of the motor for mounting and demounting the sealed assembly on the end of the camshaft; and means for closing the second end of the tubular motor shaft to prevent loss of lubricant inserted through the shaft into the sealed casing to lubricate the abutment means.

2. An assembly according to claim 1, wherein the one end of the motor shaft is externally threaded and said means for coupling the one end of the motor shaft to the inner sleeve member and the power transmitting member comprises:

a nut member mounted on the threaded end of the motor shaft and cooperating with the motor unit housing to convert rotation of the shaft to axial movement of the nut;

a support member rotatably mounted on the nut member and including an abutment means extending transversely to the axis of the motor shaft and slidably disposed in the slits to generate relative angular displacement of the inner and outer sleeves in response to axial movement of the nut member on the motor shaft.

3. An assembly according to claim 1, wherein said means for closing the second end of the motor shaft comprises a plug fitted into the second end of the shaft.

4. An assembly according to claim 3, wherein the second end of the housing has an opening coaxial with the second end of the motor shaft, and the means for closing the second of the motor shaft further comprises a cap covering the opening in the second of the motor housing.

5. An assembly according to claim 1, wherein said first connection means comprises a plurality of bolts attaching the power transmitting member to the first end of the casing and an O-ring disposed between the casing and the power transmitting member.

6. An assembly according to claim 1, wherein said second connection means comprises a bearing unit, a first O-ring arranged between the bearing unit and the second end of the casing, and a second O-ring arranged between the bearing unit and the motor housing; and wherein the bearing means comprises a second bearing unit, a third O-ring arranged between the second bearing unit and the second sleeve member, and a fourth O-ring arranged between the second bearing unit and first sleeve member.

* * * * *

UNITED STATES PATENT AND TRADEMARK OFFICE

CERTIFICATE OF CORRECTION

PATENT NO. : 4,561,390

DATED : December 31, 1985

INVENTOR(S) : N. Nakamura et al.

It is certified that error appears in the above-identified patent and that said Letters Patent is hereby corrected as shown below:

Column 6, line 42, between "second" and "of", insert the word --end--.

Column 6, line 43, between "second" and "of", insert the word --end--.

Column 6, line 58, after "unit and" insert the word --the--.

Signed and Sealed this

*Fifth* Day of *August 1986*

[SEAL]

*Attest:*

DONALD J. QUIGG

*Attesting Officer*

*Commissioner of Patents and Trademarks*